US010626476B2

(12) United States Patent
Kim et al.

(10) Patent No.: US 10,626,476 B2
(45) Date of Patent: Apr. 21, 2020

(54) HIGH SPECIFIC STRENGTH STEEL SHEET AND METHOD FOR MANUFACTURING SAME

(71) Applicants: POSCO, Pohang-si, Gyeongsangbuk-do (KR); POSTECH ACADEMY-INDUSTRY FOUNDATION, Pohang-si, Kyungsangbook-do (KR)

(72) Inventors: Han-Soo Kim, Pohang-si (KR); Nack-Joon Kim, Pohang-si (KR); Yoon-Uk Heo, Pohang-si (KR); Sang-Heon Kim, Busan (KR); Jae-Sang Lee, Pohang-si (KR); Jin-Mo Koo, Pohang-si (KR)

(73) Assignees: POSCO, Pohang-si, Gyeongsangbuk-do (KR); Postech Academy-Industry Foundation, Pohang-si, Kyungsangbook-do (KR)

( * ) Notice: Subject to any disclaimer, the term of this patent is extended or adjusted under 35 U.S.C. 154(b) by 658 days.

(21) Appl. No.: 15/108,239

(22) PCT Filed: Dec. 26, 2013

(86) PCT No.: PCT/KR2013/012163
§ 371 (c)(1),
(2) Date: Jun. 24, 2016

(87) PCT Pub. No.: WO2015/099221
PCT Pub. Date: Jul. 2, 2015

(65) Prior Publication Data

US 2016/0319388 A1 Nov. 3, 2016

(30) Foreign Application Priority Data

Dec. 26, 2013 (KR) ..... 10-2013-0163532

(51) Int. Cl.
*C21D 8/02* (2006.01)
*C21D 9/46* (2006.01)
(Continued)

(52) U.S. Cl.
CPC ..... *C21D 9/46* (2013.01); *C21D 6/005* (2013.01); *C21D 8/0226* (2013.01);
(Continued)

(58) Field of Classification Search
None
See application file for complete search history.

(56) References Cited

U.S. PATENT DOCUMENTS 4,865,662 A 9/1989 Zimmer et al.
5,431,753 A 7/1995 Kim et al.
(Continued)

FOREIGN PATENT DOCUMENTS

EP 2653581 A2 10/2013
JP S56-003651 A 1/1981
(Continued)

OTHER PUBLICATIONS

Machine-English translation of JP 2006-176843, Oka Masaharu et al., Dec. 22, 2004.*
(Continued)

*Primary Examiner* — Colin W. Slifka
(74) *Attorney, Agent, or Firm* — Morgan, Lewis & Bockius LLP

(57) ABSTRACT

A high specific strength steel sheet and a method for manufacturing same are disclosed. The high specific strength steel sheet, which is an aspect of the present invention, is characterized in that an Fe—Al-based intermetallic compound having an average particle diameter of 20 μm or less is homogeneously dispersed in an austenite matrix, the volume fraction of the Fe—Al-based interme-
(Continued)

(a)

(b)

tallic compound is 1 to 50%, and the volume fraction of κ-carbide ($(Fe,Mn)_3AlC$) which is a perovskite carbide and has an L12 structure is 15% or less.

10 Claims, 4 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/48*** | (2006.01) |
| ***C22C 38/50*** | (2006.01) |
| ***C22C 38/58*** | (2006.01) |
| ***C22C 38/60*** | (2006.01) |
| ***C21D 6/00*** | (2006.01) |

(52) U.S. Cl.

CPC ..... *C21D 8/0236* (2013.01); *C21D 8/0247* (2013.01); *C21D 8/0263* (2013.01); *C22C 38/00* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/48* (2013.01); *C22C 38/50* (2013.01); *C22C 38/58* (2013.01); *C22C 38/60* (2013.01); *C21D 8/02* (2013.01); *C21D 2211/001* (2013.01); *C21D 2211/004* (2013.01)

(56) References Cited

U.S. PATENT DOCUMENTS

| | | | | |
|---|---|---|---|---|
| 7,588,651 | B2 | 9/2009 | Engl et al. | |
| 2013/0295409 | A1* | 11/2013 | Chin | C21D 8/02 428/653 |
| 2016/0145706 | A1 | 5/2016 | Chung et al. | |

FOREIGN PATENT DOCUMENTS

| | | | |
|---|---|---|---|
| JP | H5-504788 | A | 7/1993 |
| JP | H6-505535 | A | 6/1994 |
| JP | 2003-118000 | A | 4/2003 |
| JP | 2005-15909 | A | 1/2005 |
| JP | 2005-068549 | A | 3/2005 |
| JP | 2005-120399 | A | 5/2005 |
| JP | 2006-509912 | A | 3/2006 |
| JP | 2006-118000 | A | 5/2006 |
| JP | 2006-176843 | A | 7/2006 |
| JP | 2007-084882 | A | 4/2007 |
| JP | 4235077 | B2 | 3/2009 |
| KR | 10-2013-0034727 | A | 4/2013 |
| WO | 91/03580 | A1 | 3/1991 |

OTHER PUBLICATIONS

Machine-English translation of JP 2006-118000, Fujita Nobuhiro et al., Oct. 21, 2004.*

Office Action issued in corresponding Japanese Patent Application No. 2016-543084, dated Sep. 5, 2017.

Extended European Search Report dated Jan. 17, 2017 issued in European Patent Application No. 13900531.8.

International Search Report issued in corresponding International Patent Application No. PCT/KR2013/012163, dated Sep. 26, 2014; 4 pages with English lanuage translation.

* cited by examiner

【Figure 1】
(a)
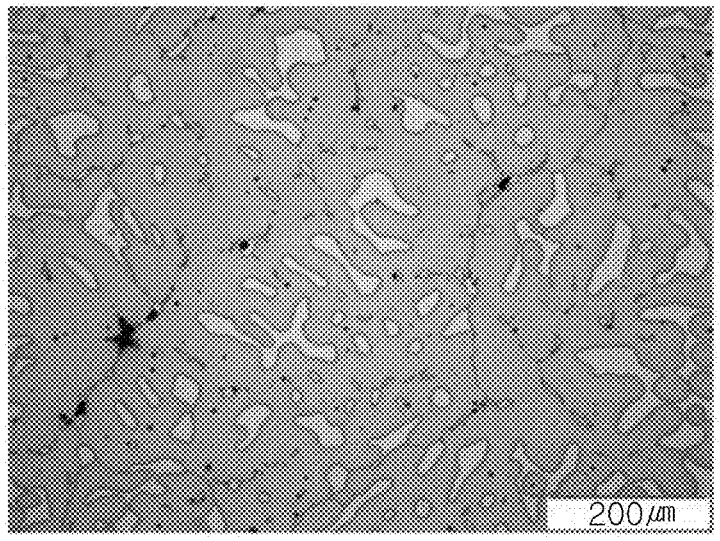
(b)
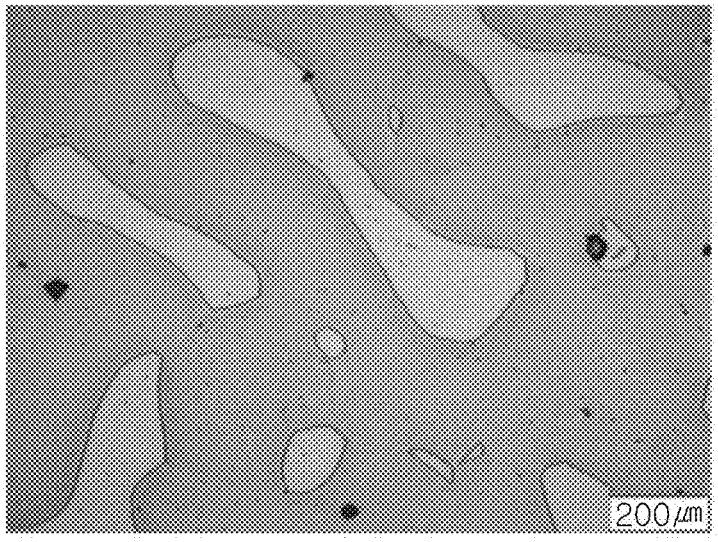

【Figure 2】
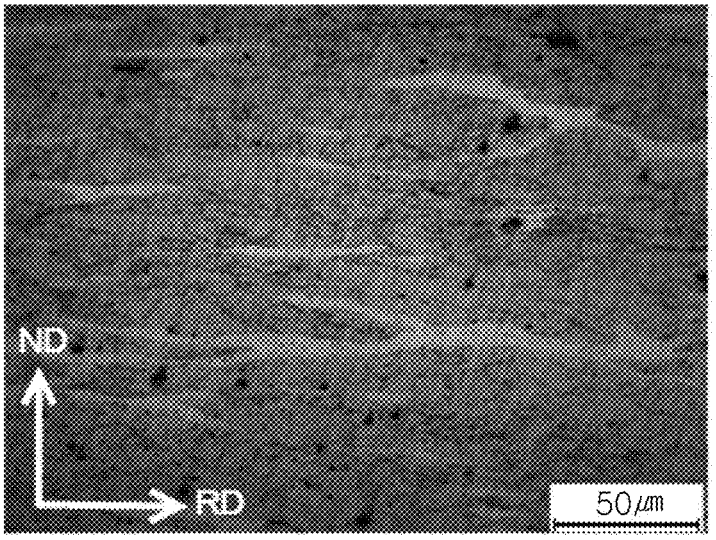
【Figure 3】
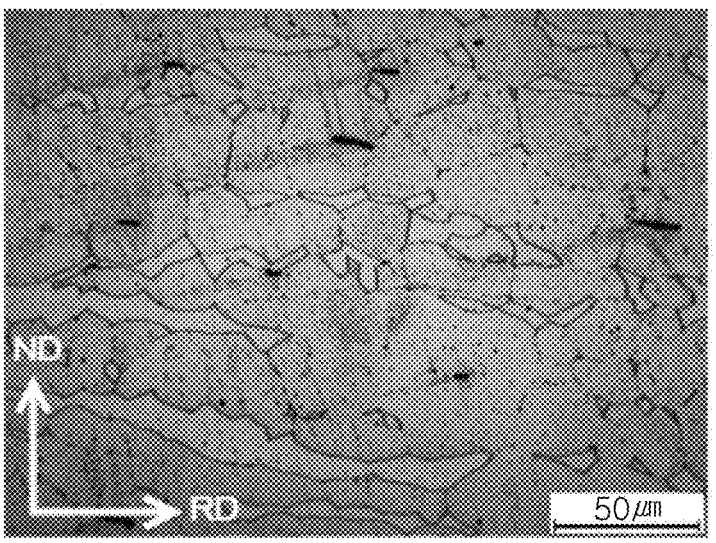

【Figure 4】
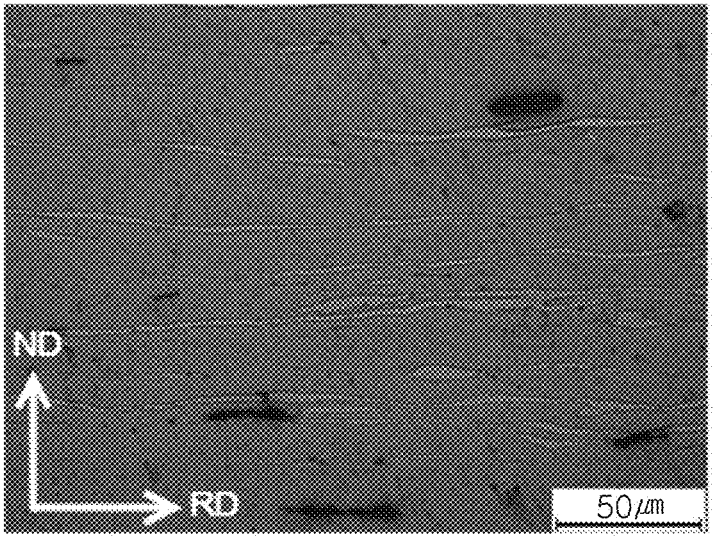
【Figure 5】
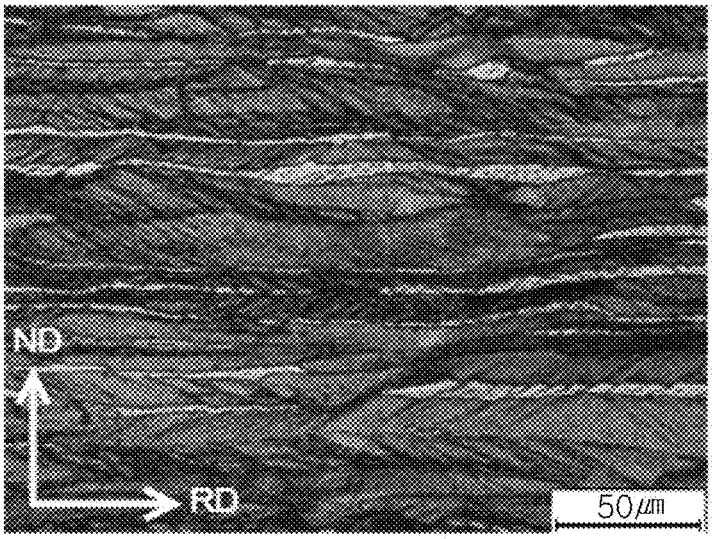

【Figure 6】
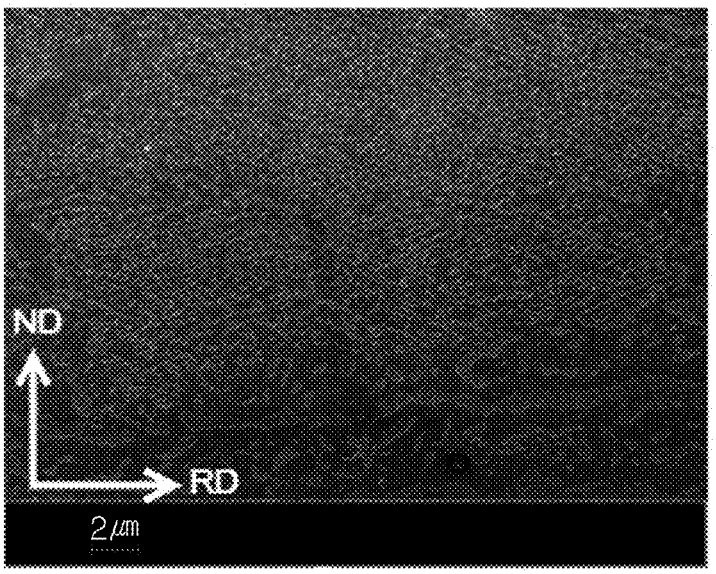
【Figure 7】
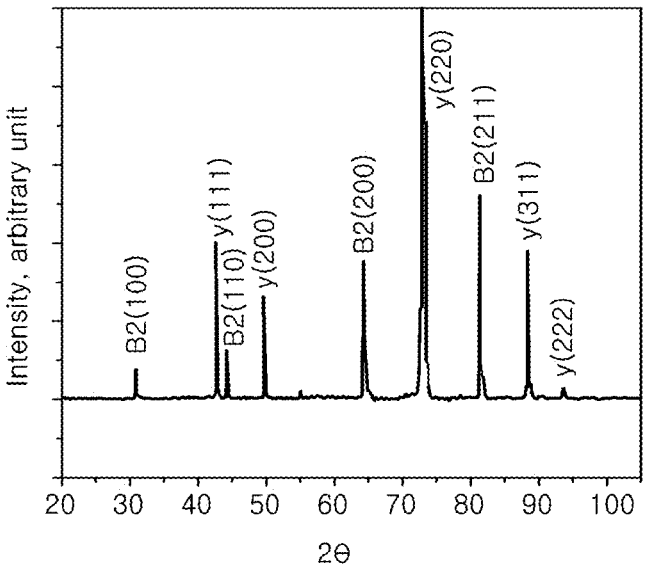

HIGH SPECIFIC STRENGTH STEEL SHEET AND METHOD FOR MANUFACTURING SAME

CROSS-REFERENCE TO RELATED APPLICATION

This application is the U.S. National Phase under 35 U.S.C. § 371 of International Patent Application No. PCT/KR2013/012163, filed on Dec. 26, 2013, which in turn claims the benefit and priority from Korean Patent Application Numbers 10-2013-0163532, filed Dec. 26, 2013, the subject matters of which are hereby incorporated by reference.

TECHNICAL FIELD

The present disclosure relates to a high specific strength steel sheet having a high degree of strength compared to the specific gravity thereof and usable as an automotive steel sheet, and a method for manufacturing the high specific strength steel sheet.

BACKGROUND ART

Recently, the necessity for lightweight automobiles has significantly increased to address environmental problems by reducing the emission of exhaust gases causing the greenhouse effect and improving the fuel efficiency of automobiles. Here, the use of high-strength steels is effective in reducing the weight of car bodies. However, if there is a lower limit to the thickness of automotive steel sheets to satisfy stiffness requirements of structural members, even if high-strength steel sheets are used, it may be difficult to reduce the weight of automobiles because the thickness of the high-strength steel sheets cannot be reduced below the lower thickness limit.

As a method of realizing weight reductions, aluminum alloy sheets having a specific gravity lower than that of steel sheets may be used. However, aluminum alloy sheets are expensive and have low workability compared to steel sheets, and it is difficult to weld aluminum alloy sheets to steel sheets. Therefore, the application of aluminum alloy sheets to automobiles is limited.

High-aluminum steels made by adding aluminum to iron in large amounts have a high degree of strength and a low degree of specific gravity and are thus theoretically effective in reducing the weight of automotive components. However, it is practically difficult to use high-aluminum steel sheets as automotive steel sheets that should have both high strength and high formability because of characteristics of high-aluminum steel sheets such as: (1) poor manufacturability, for example, cracking during a rolling process, (2) a low degree of ductility, and (3) the necessity of complicated heat treatment processes.

Particularly, it is theoretically possible to reduce the weight of steel sheets by increasing the content of aluminum (Al). In this case, however, the ductility, hot workability, and cold workability of such steel sheets are markedly decreased because of the precipitation of intermetallic compounds such as $Fe_3Al$, having a DO3 structure, or FeAl, having a B2 structure. Furthermore, if manganese (Mn) and carbon (C), austenite stabilizing elements, are added to the steel sheets in large amounts so as to suppress the formation of intermetallic compounds, κ-carbide ($(Fe,Mn)_3AlC$), a perovskite carbide having an L12 structure may precipitate in large amounts, and thus the ductility, hot workability, and cold workability of such steel sheets may be markedly decreased. Therefore, it is difficult to manufacture such high-aluminum steel sheets through general steel sheet manufacturing processes or to impart proper degrees of strength and ductility to such high-aluminum steel sheets.

In this regard, Japanese Patent Application Laid-open Publication No. 2005-120399 discloses a technique for improving the ductility and rollability of a high specific strength steel by adding aluminum, the high specific strength steel including, by wt %, C: 0.01% to 5%, Si<3%, Mn: 0.01% to 30%, P<0.02%, S<0.01%, Al: 10% to 32%, and N: 0.001% to 0.05%, wherein the high specific strength steel includes at least one optional element selected from Ti, Nb, Cr, Ni, Mo, Co, Cu, B, V, Ca, Mg, a rare earth metal (REM), and Y, and a balance of Fe. In addition, Japanese Patent Application Laid-open Publication No. 2005-120399 discloses a method of preventing grain boundary embrittlement caused by the precipitation of intermetallic compounds such as $Fe_3Al$ and FeAl in high-aluminum steel having an aluminum content greater than 10% by (1) optimizing hot rolling conditions to suppress the precipitation of intermetallic compounds such as $Fe_3Al$ and FeAl during hot rolling, cooling, and coiling processes, (2) suppressing the embrittlement of the high-aluminum steel by minimizing the contents of sulfur (S) and phosphorus (P) and inducing grain refinement using fine carbonitrides, and (3) guaranteeing manufacturability by adding chromium (Cr), cerium (Ce), and boron (B) if it is difficult to suppress the precipitation of intermetallic compounds. However, there is no way to confirm improvements in rollability by these techniques. In addition, according to the techniques, a low degree of yield strength may be obtained, and ductility may be only slightly increased. Thus, the application of the techniques to automotive members is limited.

In addition, for example, as a technique for improving the ductility and rollability of a high-aluminum steel sheet and improving manufacturability to manufacture the high-aluminum steel sheet through general thin steel sheet manufacturing processes while imparting satisfactory strength-ductility characteristics to the high-aluminum steel sheet, Japanese Patent Application Laid-open Publication No. 2006-176843 discloses a high specific strength steel including aluminum (Al) and a method for manufacturing the high specific strength steel, the high specific strength steel including, by wt %, C: 0.8% to 1.2%, Si<3%, Mn: 10% to 30%, P<0.02%, S<0.02%, Al: 8% to 12%, and N: 0.001% to 0.05%, wherein the high specific strength steel includes at least one optional element selected from Ti, Nb, Cr, Ni, Mo, Cu, B, V, Ca, Mg, Zr, and a REM, and a balance of Fe. The disclosed technique proposes a method of improving the ductility of steel having a high weight percentage of aluminum (Al) within the range of 8.0% to 12.0% by (1) adding carbon (C) in an amount of 0.8% to 1.2% and manganese (Mn) in an amount of 10% to 30% to form an austenite matrix (area fraction >90%), and (2) optimizing manufacturing conditions to suppress the precipitation of ferrite and κ-carbide ($(Fe,Mn)_3AlC$) (ferrite: 5 area % or less, κ-carbide: 1 area % or less). However, since the steel proposed in the disclosed technique has a low degree of yield strength, there are limitations in applying the steel to automotive members requiring impact resistance.

For example, as a technique for improving the ductility and rollability of a high-aluminum steel sheet and improving manufacturability to manufacture the high-aluminum steel sheet through general thin steel sheet manufacturing processes while imparting a satisfactory strength-ductility level to the high-aluminum steel sheet, Japanese Patent Application Laid-open Publication No. 2006-118000 discloses a high specific strength steel including aluminum (Al) and a method for manufacturing the high specific strength steel, the high specific strength steel including, by wt %, C: 0.1% to 1.0%, Si<3%, Mn: 10% to 50%, P<0.01%, S<0.01%, Al: 5% to 15%, N: 0.001% to 0.05, wherein the high specific strength steel includes at least one optional element selected from Ti, Nb, Cr, Ni, Mo, Co, Cu, B, V, Ca, Mg, an REM, and Y, and a balance of Fe. The disclosed technique proposes a method of improving a strength-ductility balance by adjusting phase fractions of a metal microstructure and forming a composite microstructure of ferrite and austenite.

For example, as a technique for improving the ductility and rollability of a high-aluminum steel sheet for automobiles and improving manufacturability to manufacture the high-aluminum steel sheet through general thin steel sheet manufacturing processes while imparting a satisfactory strength-ductility level to the high-aluminum steel sheet, Japanese Patent No. 4235077 discloses a high specific strength steel including aluminum (Al) and a method for manufacturing the high specific strength steel, the high specific strength steel including, by wt %, C: 0.01% to 5.0%, Si<3%, Mn: 0.21% to 30%, P<0.1%, S<0.005, Al: 3.0% to 10%, N: 0.001% to 0.05%, wherein the high specific strength steel includes at least one optional element selected from Ti, Nb, Cr, Ni, Mo, Co, Cu, B, V, Ca, Mg, an REM, Y, Ta, Zr, Hf, W, and a balance of Fe. The disclosed technique is basically for improving toughness by suppressing grain boundary embrittlement. To this end, the disclosed technique proposes a method of manufacturing a high specific strength steel sheet (having a strength of 440 MPa or greater) by (1) markedly reducing the contents of sulfur (S) and phosphorus (P), (2) properly adjusting the content of carbon (C) to ensure manufacturability, and (3) limiting the contents of heavy elements.

For example, as a technique for reliably manufacturing a high specific strength steel sheet having a high aluminum content, Japanese Patent Application Laid-open Publication (Translation of PCT Application) No. 2006-509912 discloses a high specific strength steel including aluminum (Al) and a method for manufacturing the high specific strength steel, the high specific strength steel including, by wt %, C: 1% or less, Mn: 7.0% to 30.0%, Al: 1.0% to 10.0%, Si: from greater than 2.5% to 8%, Al+Si: from greater than 3.5% to 12%, B<0.01%, Ni<8%, Cu<3%, N<0.6%, Nb<0.3%, Ti<0.3%, V<0.3%, P<0.01%, and a balance of inevitable impurities and Fe. According to the disclosed technique, after general processes for manufacturing a steel strip and a steel sheet, a room-temperature forming process is performed to adjust the yield strength of a final steel product. The disclosed technique is for twinning-induced plasticity (TWIP) steels.

DISCLOSURE

Technical Problem

Aspects of the present disclosure may include a high specific strength steel sheet having high degrees of ductility, yield strength, work hardenability, hot workability, and cold workability, and a method for manufacturing the high specific strength steel sheet.

Technical Solution

According to an aspect of the present disclosure, a high specific strength steel sheet may include: an Fe—Al-based intermetallic compound in an austenite matrix in a volume fraction of 1% to 50%; and κ-carbide ($(Fe,Mn)_3AlC$), a perovskite carbide having an L12 structure in the austenite matrix in a volume fraction of 15% or less.

According to another aspect of the present disclosure, a method for manufacturing a high specific strength steel sheet may include: reheating a steel slab to 1050° C. to 1250° C., the steel slab including, by wt %, C: 0.01% to 2.0%, Si: 9.0% or less, Mn: 5.0% to 40.0%, P: 0.04% or less, S: 0.04% or less, Al: 4.0% to 20.0%, Ni: 0.3% to 20.0%, N: 0.001% to 0.05%, and a balance of iron (Fe) and inevitable impurities; hot rolling the reheated steel slab at a total reduction ratio of 60% or greater within a finish hot rolling temperature range of 900° C. or higher to obtain a hot-rolled steel sheet; and coiling the hot-rolled steel sheet after primarily cooling the hot-rolled steel sheet to a temperature of 600° C. or lower at a cooling rate of 5° C./sec or greater.

The above-described aspects of the present disclosure do not include all aspects or features of the present disclosure. Other aspects or features, and effects of the present disclosure, will be clearly understood from the following descriptions of exemplary embodiments.

Advantageous Effects

According to exemplary embodiments of the present disclosure, the high specific strength steel sheet has a specific gravity of 7.47 g/cc or less, a yield strength of 600 MPa or greater, a product of ultimate tensile strength (TS) and total elongation (TE) within the range of 12,500 MPa·% or greater, and an average strain hardening rate calculated by (TS−YS)/UE (where UE refers to uniform elongation in percentage (%)) within the range of 8 MPa/% or greater. Thus, the high specific strength steel sheet may be used for applications such as automotive steel sheets.

DESCRIPTION OF DRAWINGS

FIGS. 1A and 1B are images illustrating the microstructure of a slab after a reheating process according to an exemplary embodiment of the present disclosure.

FIG. 2 is an image illustrating the microstructure of a hot-rolled steel sheet according to the exemplary embodiment of the present disclosure.

FIG. 3 is an image illustrating the microstructure of a hot-rolled steel sheet after an annealing process according to an exemplary embodiment of the present disclosure.

FIG. 4 is an image illustrating the microstructure of a cold-rolled steel sheet according to an exemplary embodiment of the present disclosure.

FIG. 5 is an image illustrating the microstructure of the cold-rolled steel sheet of the exemplary embodiment after the cold-rolled steel sheet is annealed for 1 minute.

FIG. 6 is an image illustrating the microstructure of the cold-rolled steel sheet of the exemplary embodiment after the cold-rolled steel sheet is annealed for 15 minutes.

FIG. 7 illustrates results of an X-ray diffraction analysis performed on the cold-rolled steel sheet of the exemplary embodiment after the cold-rolled steel sheet is annealed for about 15 minutes.

BEST MODE

The inventors have conducted much research into a method of improving the ductility, yield strength, work hardenability, hot workability, and cold workability of a high-aluminum, high specific strength steel sheet by focusing on two aspects: alloying elements, and manufacturing methods. As a result, the inventors found that the ductility, hot workability, and cold workability of high-aluminum steel sheets having an aluminum content within the range of 4 wt % or greater were worsened during manufacturing processes because (1) the precipitation of κ-carbide, a perovskite carbide is poorly suppressed, or (2) intermetallic compounds such as FeAl or $Fe_3Al$ precipitate in a state in which the shape, size, and distribution of the intermetallic compounds are poorly controlled.

In addition, the inventors found that in a method of manufacturing a high specific strength steel sheet by adding a properly amount of nickel (Ni) and properly adjusting the contents of carbon (C) and manganese (Mn), austenite stabilizing elements, proper adjustment of rolling and heat treatment conditions enables (1) the suppression of κ-carbide precipitation and (2) the promotion of high-temperature precipitation of an Fe—Al-based intermetallic compound, resulting in the formation of the Fe—Al-based intermetallic compound in an austenite matrix in an amount of 1% to 50% and the distribution of fine grains of the intermetallic compound such as FeAl or $Fe_3Al$ having an average grain size of 20 μm or less. Thus, a high specific strength steel sheet having high degrees of ductility, yield strength, work hardenability, and rollability can be manufactured.

In detail, if austenite stabilizing elements such as carbon (C) and manganese (Mn) are added in large amounts to a high-aluminum steel sheet, austenite coexists at high temperature with ferrite which is a disordered solid solution having a BCC structure. During cooling, the austenite decomposes into ferrite and κ-carbide, and the ferrite sequentially transforms into intermetallic compounds: FeAl having a B2 structure (hereinafter referred to as a B2 phase) and $Fe_3Al$ having a DO3 structure (hereinafter referred to as a DO3 phase). At this time, if the nucleation and growth of the intermetallic compounds having a high degree of strength are not properly controlled, the intermetallic compounds are coarsened in size and non-uniformly distributed, thereby lowering the workability and strength-ductility balance of the high-aluminum steel sheet. If nickel (Ni) is added to the high-aluminum steel sheet, the enthalpy of formation of the B2 phase is increased, thereby improving the high-temperature stability of the B2 phase. Particularly, if the content of nickel (Ni) is properly adjusted to be equal to or higher than a predetermined value, instead of ferrite, the B2 phase and austenite coexist at high temperature, and then if the high-aluminum steel sheet is properly cooled at a cooling rate equal to or higher than a predetermined value after a hot rolling process or hot rolling/cold rolling and annealing processes, excessive formation of κ-carbide is suppressed, thereby forming a microstructure mainly formed by the B2 phase and austenite at room temperature. In this manner, a high specific strength steel sheet having high degrees of ductility, rollability, yield strength, and work hardenability may be manufactured.

In addition, the inventors found that κ-carbide formed by controlling a cooling process after a hot rolling process as described above induces the planar glide of dislocations in an austenite matrix during a cold rolling process and thus the formation of high-density fine shear bands. The shear bands function as heterogeneous nucleation sites for a B2 phase when a cold-rolled steel sheet is annealed, thereby facilitating refinement and homogeneous dispersion of the B2 phase in the austenite matrix. This allows the manufacturing of an ultra high specific strength steel sheet having higher degrees of ductility, yield strength, work hardenability, hot workability, and cold workability.

Hereinafter, a high specific strength steel sheet will be described in detail according to an exemplary embodiment of the present disclosure.

The high specific strength steel sheet of the exemplary embodiment has an austenite matrix including: an Fe—Al-based intermetallic compound in a volume fraction of 1% to 50%; and κ-carbide ($(Fe,Mn)_3AlC$), a perovskite carbide having an L12 structure, in a volume fraction of 15% or less. Since the high specific strength steel sheet has a microstructure as described above, the high specific strength steel sheet may have high ductility, yield strength, work hardenability, hot workability, and cold workability.

If the fraction of the Fe—Al-based intermetallic compound is less than 1 volume %, a sufficient strengthening effect may not be obtained. Conversely, if the fraction of the Fe—Al-based intermetallic compound is greater than 50 volume %, a sufficient degree of ductility may not be obtained because of embrittlement. Therefore, according to the exemplary embodiment, preferably, the fraction of the Fe—Al-based intermetallic compound may be within the range of 1 volume % to 50 volume %, and more preferably within the range of 5 volume % to 45 volume %.

According to the exemplary embodiment, the Fe—Al-based intermetallic compound may be present in granular form with an average grain diameter within the range of 20 μm or less. The formation of coarse grains of the Fe—Al-based intermetallic compound may result in poor rollability and mechanical properties. Thus, it may be preferable that the Fe—Al-based intermetallic compound be controlled to have an average grain diameter within the range of 20 μm or less, and more preferably within the range of 2 μm or less.

According to another exemplary embodiment, the Fe—Al-based intermetallic compound may be present in granular form or in the form of bands parallel to the direction of rolling of the high specific strength steel sheet. In the latter case, it may be preferable that the volume fraction of the band-type Fe—Al-based intermetallic compound be 40% or less, and more preferably 25% or less. In addition, the bands parallel to the direction of rolling may have an average thickness of 40 μm or less, an average length of 500 μm or less, and an average width of 200 μm or less.

According to the exemplary embodiment, the Fe—Al-based intermetallic compound may have a B2 phase or a DO3 phase.

The κ-carbide ($(Fe,Mn)_3AlC$) having an L12 structure may have an negative effect on the ductility, hot workability, and cold workability of the high specific strength steel sheet. Thus, it may be required to suppress the formation of the κ-carbide ($(Fe,Mn)_3AlC$). In the exemplary embodiment, preferably, the volume fraction of the κ-carbide ($(Fe,Mn)_3AlC$) may be adjusted to be 15% or less and more preferably 7% or less.

In the microstructure of the high specific strength steel sheet, ferrite is softer than the austenite matrix and thus does not have a strengthening effect. Thus, the formation of ferrite may be suppressed. In the exemplary embodiment, preferably, the volume fraction of ferrite may be adjusted to be 15% or less, and more preferably 5% or less.

According to the exemplary embodiment, the high specific strength steel sheet having the above-described microstructure may have a specific gravity of 7.47 g/cc or less, a yield strength of 600 MPa or greater, a product of ultimate tensile strength (TS) and total elongation (TE) within the range of 12,500 MPa·% or greater, and an average strain hardening rate calculated by (TS-YS)/UE (where UE refers to uniform elongation in percentage (%)) within the range of 8 MPa/% or greater. Thus, the high specific strength steel sheet may be used for applications such as automotive steel sheets.

Hereinafter, alloying elements of the high specific strength steel sheet will be described in detail.

Carbon (C): 0.01 wt % to 2.0 wt %

Carbon (C) stabilizes the austenite matrix of the steel sheet and increases the strength by solid-solution hardening, thereby improving the strength of the steel sheet relative to the specific gravity of the steel sheet. In the exemplary embodiment, to obtain these effects, it may be preferable that the content of carbon (C) be within the range of 0.01 wt % or greater. However, if the content of carbon (C) is greater than 2.0 wt %, the precipitation of κ-carbide is facilitated at high temperatures, thereby markedly decreasing the hot workability and cold workability of the steel sheet. Thus, according to the exemplary embodiment, it may be preferable that the content of carbon (C) be within the range of 0.01 wt % to 2.0 wt %.

Silicon (Si): 9.0 wt % or Less

Silicon (Si) increases the strength of the steel sheet by solid-solution strengthening and improves the specific strength of the steel sheet owing to its low specific gravity. However, an excessive amount of silicon (Si) decreases the hot workability of the steel sheet and lowers the surface quality of the steel sheet by facilitating the formation of red scale on the steel sheet during a hot rolling process. In addition, chemical conversion treatment characteristics of the steel sheet are markedly worsened. Therefore, according to the exemplary embodiment, it may be preferable that the content of silicon (Si) is set to be 9.0 wt % or less.

Manganese (Mn): 5.0 wt % to 40.0 wt %

Manganese (Mn) stabilizes an austenite matrix. In addition, manganese (Mn) combines with sulfur (S) inevitably added during steel making processes, thereby forming MnS and suppressing grain boundary embrittlement caused by dissolved sulfur (S). In the exemplary embodiment, to obtain these effects, it may be preferable that the content of manganese (Mn) be within the range of 5.0 wt % or greater. However, if the content of manganese (Mn) is greater than 40 wt %, a β-Mn phase may be formed, or δ-ferrite may be stabilized at high temperature and thus the stability of austenite may be decreased. Thus, according to the exemplary embodiment, it may be preferable that the content of manganese (Mn) be within the range of 5.0 wt % to 40.0 wt %.

To stabilize the austenite matrix of the steel sheet, if the content of manganese (Mn) is adjusted to be within the range of 5.0 wt % to less than 14.0 wt %, the content of carbon (C) may be preferably adjusted to be 0.6 wt % or greater, and if the content of manganese (Mn) is adjusted to be within the range of 14.0 wt % to less than 20.0 wt %, the content of carbon (C) may be preferably adjusted to be 0.3 wt % or greater.

Phosphorus (P): 0.04 wt % or Less

Phosphorus (P) is an inevitable impurity segregating along grain boundaries of steel and thus decreasing the toughness of steel. Therefore, the content of phosphorus (P) is adjusted to be as low as possible. Theoretically, it is preferable to adjust the content of phosphorus (P) to be 0%. However, due to costs and the limit of current smelting technology, phosphorus (P) is inevitably included in the steel sheet. Therefore, the upper limit of the content of phosphorus (P) may be set. In the exemplary embodiment, the upper limit of the content of phosphorus (P) is set to be 0.04 wt %.

Sulfur (S): 0.04 wt % or Less

Sulfur (S) is an inevitable impurity acting as the main factor worsening the hot workability and toughness of steel. Therefore, the content of sulfur (S) is adjusted as low as possible. Theoretically, it is preferable to adjust the content of sulfur (S) to be 0%. However, due to costs and the limit of current smelting technology, sulfur (S) is inevitably included in the steel sheet. Therefore, the upper limit of the content of sulfur (S) may be set. In the exemplary embodiment, the upper limit of the content of sulfur (S) is set to be 0.04 wt %.

Aluminum (Al): 4.0 wt % to 20.0 wt %

Aluminum (Al) reduces the specific gravity of the steel sheet. In addition, aluminum (Al) forms a B2 phase and a DO3 phase, thereby improving the ductility, yield strength, work hardenability, hot workability, and cold workability of the steel sheet. In the exemplary embodiment, to obtain these effects, it may be preferable that the content of aluminum (Al) be within the range of 4.0 wt % or greater. However, if the content of aluminum (Al) is greater than 20.0 wt %, κ-carbide may precipitate excessively, and thus the ductility, hot workability, and cold workability of the steel sheet may be markedly decreased. Thus, according to the exemplary embodiment, it may be preferable that the content of aluminum (Al) be within the range of 4.0 wt % to 20.0 wt %.

Nickel (Ni): 0.3 wt % to 20.0 wt %

Nickel (Ni) prevents excessive precipitation of κ-carbide and stabilizes a B2 phase at high temperature, thereby guaranteeing the formation of a microstructure intended in the exemplary embodiment, that is, the formation of an austenite matrix in which an Fe—Al-based intermetallic compound is homogeneously dispersed. If the content of nickel (Ni) is less than 0.3 wt %, the effect of stabilizing a B2 phase at high temperature is very small, and thus an intended microstructure may not be obtained. Conversely, if the content of nickel (Ni) is greater than 20.0 wt %, the fraction of a B2 phase may increase excessively, markedly decreasing the cold workability of the steel sheet. Therefore, according to the exemplary embodiment, it may be preferable that the content of nickel (Ni) be within the range of 0.3 wt % to 20.0 wt %, more preferably within the range of 0.5 wt % to 18 wt %, and even more preferably within the range of 1.0 wt % to 15 wt %.

Nitrogen (N): 0.001 wt % to 0.05 wt %

Nitrogen (N) forms nitrides in steel and thus prevents grain coarsening. In the exemplary embodiment, to obtain these effects, it may be preferable that the content of nitrogen (N) be within the range of 0.001 wt % or greater. However, if the content of nitrogen (N) is greater than 0.05 wt %, the toughness of the steel sheet may be decreased. Thus, according to the exemplary embodiment, it may be preferable that the content of nitrogen (N) be within the range of 0.001 wt % to 0.05 wt %.

The steel sheet may include iron (Fe) and inevitable impurities as the remainder of constituents. However, the addition of elements other than the above-described elements is not excluded. For example, the following elements may be added to the steel sheet according to an intended strength-ductility balance and other characteristics.

Chromium (Cr): 0.01 wt % to 7.0 wt %

Chromium (Cr) is an element for improving the strength-ductility balance of steel and suppressing the precipitation of κ-carbide. In the exemplary embodiment, to obtain these effects, it may be preferable that the content of chromium (Cr) be within the range of 0.01 wt % or greater. However, if the content of chromium (Cr) is greater than 7.0 wt %, the ductility and toughness of steel may deteriorate. In addition, the formation of carbides such as cementite ((Fe,Mn)3C) may be facilitated at high temperatures, markedly decreasing the hot workability and cold workability of steel. Therefore, according to the exemplary embodiment, it may be preferable that the content of chromium (Cr) be within the range of 0.01 wt % to 7.0 wt %.

Co, Cu, Ru, Rh, Pd, Ir, Pt, and Au: 0.01 wt % to 15.0 wt %

These elements have functions similar to that of nickel (Ni). These elements may chemically combine with aluminum (Al) included in steel and may thus stabilize a B2 phase at high temperature. In the exemplary embodiment, to obtain these effects, it may be preferable that the content of these elements be within the range of 0.01 wt % or greater. However, if the content of the elements is greater than 15.0 wt %, precipitation may excessively occur. Therefore, according to the exemplary embodiment, it may be preferable that the content of the elements be within the range of 0.01 wt % to 15.0 wt %.

Lithium (Li): 0.001 wt % to 3.0 wt %

Lithium (Li) combines with aluminum (Al) included in steel and stabilizes a B2 phase at high temperature. In the exemplary embodiment, to obtain these effects, it may be preferable that the content of lithium (Li) be within the range of 0.001 wt % or greater. However, lithium (Li) has a very high chemical affinity for carbon (C). Thus, if lithium (Li) is excessively added, carbides may be excessively formed, and thus the properties of the steel sheet may deteriorate. Therefore, in the exemplary embodiment, it may be preferable that the upper limit of the content of lithium (Li) be set to be 3.0 wt %.

Sc, Ti, Sr, Y, Zr, Mo, Lu, Ta, and lanthanoid rare earth metal (REM): 0.005 wt % to 3.0 wt %

These elements combine with aluminum (Al) included in steel and stabilize a B2 phase at high temperature. In the exemplary embodiment, to obtain these effects, it may be preferable that the content of these elements be within the range of 0.005 wt % or greater. However, the elements have a very high chemical affinity for carbon (C). Thus, if the elements are excessively added to steel, carbides may be excessively formed, and thus the properties of steel may deteriorate. Therefore, in the exemplary embodiment, it may be preferable that the upper limit of the content of the elements be set to be 3.0 wt %.

Vanadium (V) and Niobium (Nb): 0.005 wt % to 1.0 wt %

Vanadium (V) and niobium (Nb), which are carbide forming elements, improve the strength and formability of low-carbon, high-manganese steel sheets such as the steel sheet of the exemplary embodiment. In addition, vanadium (V) and niobium (Nb) improve toughness by inducing grain refinement. In the exemplary embodiment, to obtain these effects, it may be preferable that the content of vanadium (V) and niobium (Nb) be within the range of 0.005 wt % or greater. However, if the content of these elements is greater than 1.0 wt %, the manufacturability and properties of the steel sheet may deteriorate due to excessive precipitation of carbides. Thus, in the exemplary embodiment, it may be preferable that the upper limit of the content of the elements be 1.0 wt %.

Tungsten (W): 0.01 wt % to 5.0 wt %

Tungsten (W) improves the strength and toughness of steel. In the exemplary embodiment, to obtain these effects, it may be preferable that the content of tungsten (W) be within the range of 0.01 wt % or greater. However, if the content of tungsten (W) is greater than 5.0 wt %, the manufacturability and properties of the steel sheet may deteriorate due to excessive formation of hard phases or precipitates. Thus, in the exemplary embodiment, it may be preferable that the upper limit of the content of tungsten (W) be 5.0 wt %.

Calcium (Ca): 0.001 wt % to 0.02 wt %, Magnesium (Mg): 0.0002 wt % to 0.4 wt %

Calcium (Ca) and magnesium (Mg) lead to the formation of sulfides and/or oxides, thereby improving the toughness of steel. In the exemplary embodiment, to obtain these effects, it may be preferable that the content of calcium (Ca) be within the range of 0.001 wt % or greater, and the content of magnesium (Mg) be within the range of 0.0002 wt %. However, if calcium (Ca) and magnesium (Mg) are excessively added, the number density or size of inclusions may increase, and thus the toughness and workability of the steel sheet may be markedly decreased. Therefore, preferably, the upper limits of the contents of calcium (Ca) and magnesium (Mg) may be set to be 0.02 wt % and 0.4 wt %, respectively.

Boron (B): 0.0001 wt % to 0.1 wt %

Boron (B) is an effective grain boundary strengthening element. In the exemplary embodiment, preferably, the content of boron (B) may be adjusted to be 0.0001 wt % or greater to obtain this effect. However, if the content of boron (B) is greater than 0.1 wt %, the workability of the steel sheet may be markedly decreased. Therefore, it is preferable that the upper limit of the content of boron (B) be 0.1 wt %.

The above-described high specific strength steel sheet of the exemplary embodiment may be manufactured by various methods. That is, the high specific strength steel sheet is not limited to a particular manufacturing method. For example, the high specific strength steel sheet may be manufactured by one of the following five methods.

(1) Slab Reheating—Hot Rolling—Cooling, and Coiling

First, a steel slab having the above-described composition is reheated to a temperature within a range of 1050° C. to 1250° C. If the slab reheating temperature is lower than 1050° C., carbonitrides may not be sufficiently dissolved. In this case, intended degrees of strength and ductility may not be obtained, and a hot-rolled steel sheet may undergo hot rupture due to low toughness. In particular, the upper limit of the slab reheating temperature may have a large effect on a high carbon steel. The upper limit of the slab reheating temperature may be set to be 1250° C. so as to guarantee hot workability.

Thereafter, the reheated steel slab is hot rolled to obtain a hot-rolled steel sheet. At this time, preferably, the total reduction ratio of the hot rolling process may be adjusted to be 60% or greater so as to promote homogenization and grain refinement of a B2 band microstructure, and the finish hot rolling temperature of the hot rolling process may be adjusted to be 900° C. or higher so as to prevent excessive precipitation of κ-carbide ($(Fe,Mn)_3AlC$) which is a brittle phase.

Thereafter, the hot-rolled steel sheet is cooled to 600° C. or lower at a cooling rate of 5° C./sec or greater and then coiled. If the hot-rolled steel sheet is cooled at a cooling rate of less than 5° C./sec, κ-carbide ($(Fe,Mn)_3AlC$), a brittle phase, may precipitate excessively during the hot-rolled steel sheet is cooled, and thus the ductility of the steel sheet may deteriorate. As the cooling rate increases, the precipitation of κ-carbide ($(Fe,Mn)_3AlC$) is more effectively prevented. Thus, according to an exemplary embodiment, the upper limit of the cooling rate may not be set.

If the coiling start temperature of the hot-rolled steel sheet is higher than 600° C. when the hot-rolled steel sheet is coiled, κ-carbide ($(Fe,Mn)_3AlC$), a brittle phase, may precipitate excessively after the coiled hot-rolled steel sheet is cooled, and thus the ductility of the steel sheet may deteriorate. However, if the coiling start temperature of the hot-rolled steel sheet is lower than 600° C., problems relating to the precipitation of κ-carbide ($(Fe,Mn)_3AlC$) do not occur. Thus, according to the exemplary embodiment, the lower limit of the coiling start temperature may not be set.

FIGS. 1A and 1B are images illustrating the microstructure of a slab after a reheating process according to the exemplary embodiment of the present disclosure. Referring to FIGS. 1A and 1B, in a steel sheet of the exemplary embodiment of the present disclosure, instead of ferrite, a B2 phase and austenite coexist at high temperature because the steel sheet has a proper content of nickel (Ni).

FIG. 2 is an image illustrating the microstructure of the steel sheet after a hot rolling process according to the exemplary embodiment of the present disclosure. The B2 phase is stretched in a direction parallel to the direction of rolling and thus has a band shape having a width of about 10 μm. An austenite matrix of the steel sheet has a modified structure due to partial recrystallization. Referring to FIG. 2, since the finish hot rolling temperature of the steel sheet of the exemplary embodiment is properly adjusted, excessive precipitation of κ-carbide ($(Fe,Mn)_3AlC$), a brittle phase, is suppressed.

(2) Slab Reheating—Hot Rolling—Cooling, and Coiling—Annealing—Cooling

According to an exemplary embodiment of the present disclosure, after reheating, hot rolling, cooling, and coiling processes, a coiled hot-rolled steel sheet may be annealed at 800° C. to 1250° C. for 1 minute to 60 minutes so as to further improve the ductility of the hot-rolled steel sheet.

The annealing process is performed to reduce residual stress formed during the hot rolling process and the cooling process, and to more precisely adjust the volume fraction, shape, and distribution of a B2 phase in an austenite matrix. Since the fractions of austenite and the B2 phase relative to each other are determined by the temperature of the annealing process, the strength-ductility balance of the steel sheet may be adjusted according to intended properties by controlling the annealing process. The annealing temperature may preferably be 800° C. or higher so as to prevent excessive precipitation of κ-carbide ($(Fe,Mn)_3AlC$) and may preferably be 1250° C. or lower so as to prevent grain coarsening.

If the duration of the annealing process is shorter than 1 minute, B2 bands are not sufficiently modified to have a granular form. Conversely, if the duration of the annealing process is longer than 60 minutes, productivity decreases, and grain coarsening may occur. Thus, it may be preferable that the duration of the annealing process be within the range of 1 minute to 60 minutes, and more preferably within the range of 5 minutes to 30 minutes.

Thereafter, the annealed hot-rolled steel sheet is cooled to 600° C. or lower at a cooling rate of 5° C./sec or greater, and is then coiled. If the annealed hot-rolled steel sheet is cooled at a cooling rate of less than 5° C./sec, κ-carbide ($(Fe,Mn)_3AlC$), a brittle phase, may precipitate excessively during the annealed hot-rolled steel sheet is cooled, and thus the ductility of the steel sheet may deteriorate. As the cooling rate increases, the precipitation of κ-carbide ($(Fe,Mn)_3AlC$) is more effectively prevented. Thus, according to the exemplary embodiment, the upper limit of the cooling rate may not be set.

If the coiling start temperature of the annealed hot-rolled steel sheet is higher than 600° C. when the annealed hot-rolled steel sheet is coiled, κ-carbide ($(Fe,Mn)_3AlC$), a brittle phase, may precipitate excessively during the coiled hot-rolled steel sheet is being cooled, and thus the ductility of the steel sheet may deteriorate. However, if the coiling start temperature of the hot-rolled steel sheet is lower than 600° C., problems relating to the precipitation of κ-carbide ($(Fe,Mn)_3AlC$) do not occur. Thus, according to the exemplary embodiment, the lower limit of the coiling start temperature may not be set.

FIG. 3 is an image illustrating the microstructure of a hot-rolled steel sheet after an annealing process to the exemplary embodiment of the present disclosure. The grain size of an austenite matrix ranges from 20 μm to 50 μm, and even though a B2 phase partially has a band shape parallel to the direction of rolling, most of the B2 bands are decomposed to have a granular form having a size of 5 μm to 10 μm.

(3) Slab Reheating—Hot Rolling—Cooling; Coiling—Primary Annealing; and Cooling—Secondary Annealing—Cooling According to another exemplary embodiment, after performing reheating, hot rolling, cooling, coiling, primary annealing, and cooling processes as described above, a secondary annealing process may be performed within a temperature range of 800° C. to 1100° C. for 30 seconds to 60 minutes.

The secondary annealing process is performed for refinement and homogeneous dispersion of a B2 phase in an austenite matrix. In the exemplary embodiment, to obtain these effects, it may be preferable that the temperature of the secondary annealing process be 800° C. or higher. However, if the temperature of the secondary annealing process is higher than 1100° C., grain coarsening may occur, and the fraction of the B2 phase may decrease. Therefore, it may be preferable that the temperature of the secondary annealing process be within the range of 800° C. to 1100° C., and more preferably within the range of 800° C. to 1000° C.

If the duration of the secondary annealing process is shorter than 30 seconds, the B2 phase may not sufficiently precipitate, and if the duration of the secondary annealing process is longer than 60 minutes, grain coarsening may occur. Therefore, it may be preferable that the duration of the secondary annealing process be within the range of 30 seconds to 60 minutes, and more preferably within the range of 1 minute to 30 minutes.

Thereafter, a secondarily annealed hot-rolled steel sheet is cooled to 600° C. or lower at a cooling rate of 5° C./sec or greater. When the secondarily annealed hot-rolled steel sheet is cooled, if the cooling rate is less than 5° C./sec, κ-carbide ($(Fe,Mn)_3AlC$), a brittle phase, may precipitate excessively during the cooling, and thus the ductility of the steel sheet may deteriorate. As the cooling rate increases, the precipitation of κ-carbide ($(Fe,Mn)_3AlC$) is more effectively prevented. Thus, according to the exemplary embodiment, the upper limit of the cooling rate may not be set.

When the secondarily annealed hot-rolled steel sheet is cooled, if the cooling finish temperature of the secondarily annealed hot-rolled steel sheet is higher than 600° C., κ-carbide ($(Fe,Mn)_3AlC$), a brittle phase, may precipitate excessively after the secondarily annealed hot-rolled steel sheet is cooled, and thus the ductility of the steel sheet may deteriorate. However, if the cooling finish temperature of the secondarily annealed hot-rolled steel sheet is lower than 600° C., problems relating to the precipitation of κ-carbide ($(Fe,Mn)_3AlC$) do not occur. Thus, according to the exemplary embodiment, the lower limit of the cooling finish temperature may not be set.

(4) Slab Reheating—Hot Rolling—Cooling, and Coiling—Cold Rolling—Annealing—Cooling According to another exemplary embodiment of the present disclosure, after performing reheating, hot rolling, cooling, and coiling processes as described above, a coiled hot-rolled steel sheet may be cold rolled at a temperature of −20° C. or higher at a reduction ratio of 30% or greater to manufacture a cold-rolled steel sheet. The cold rolling process is performed to sufficiently form fine shear bands, and to obtain this effect in the exemplary embodiment, it may be preferable that the total reduction ratio of the cold rolling process be 30% or greater.

The cold-rolled steel sheet is annealed at 800° C. to 1100° C. for 30 seconds to 60 minutes. Shear bands formed during the cold rolling process may function as heterogeneous nucleation sites for a B2 phase during the annealing process and thus promote refinement and homogeneous dispersion of the B2 phase in an austenite matrix. In the exemplary embodiment, to obtain these effects, it may be preferable that the temperature of the annealing process be 800° C. or higher. However, if the temperature of the annealing process is higher than 1100° C., grain coarsening may occur, and the fraction of the B2 phase may decrease. Therefore, it may be preferable that the temperature of the annealing process be within the range of 800° C. to 1100° C., and more preferably within the range of 800° C. to 1000° C.

If the duration of the annealing process is shorter than 30 seconds, the B2 phase may not sufficiently precipitate, and if the duration of the secondary annealing process is longer than 60 minutes, grain coarsening may occur. Therefore, it may be preferable that the duration of the annealing process be within the range of 30 seconds to minutes, and more preferably within the range of 1 minute to 30 minutes.

Thereafter, the annealed cold-rolled steel sheet is cooled to 600° C. or lower at a cooling rate of 5° C./sec or greater, and is then coiled. If the annealed cold-rolled steel sheet is cooled at a cooling rate of less than 5° C./sec, κ-carbide ($(Fe,Mn)_3AlC$), a brittle phase, may precipitate excessively while the annealed cold-rolled steel sheet is cooled, and thus the ductility of the steel sheet may deteriorate. As the cooling rate increases, the precipitation of κ-carbide ($(Fe,Mn)_3AlC$) is more effectively prevented. Thus, according to the exemplary embodiment, the upper limit of the cooling rate may not be set.

If the cooling finish temperature of the annealed cold-rolled steel sheet is higher than 600° C. when the annealed cold-rolled steel sheet is cooled, κ-carbide ($(Fe,Mn)_3AlC$), a brittle phase, may precipitate excessively after the annealed cold-rolled steel sheet is cooled, and thus the ductility of the steel sheet may deteriorate. However, if the cooling finish temperature of the annealed hot-rolled steel sheet is lower than 600° C., problems relating to the precipitation of κ-carbide ($(Fe,Mn)_3AlC$) do not occur. Thus, according to the exemplary embodiment, the lower limit of the cooling finish temperature may not be set.

(5) Slab Reheating—Hot Rolling—Cooling, and Coiling—Annealing—Cold Rolling—Annealing—Cooling According to another exemplary embodiment, after performing reheating, hot rolling, cooling, coiling, annealing, and cold rolling processes as described above, a cold-rolled steel sheet may be annealed with a temperature range of 800° C. to 1100° C. for 30 seconds to 60 minutes. Shear bands formed during the cold rolling process function as heterogeneous nucleation sites for a B2 phase during the annealing process and thus promote refinement and homogeneous dispersion of the B2 phase in an austenite matrix. In the exemplary embodiment, to obtain these effects, it may be preferable that the temperature of the annealing process be 800° C. or higher. However, if the temperature of the annealing process is higher than 1100° C., grain coarsening may occur, and the fraction of the B2 phase may decrease. Therefore, it may be preferable that the temperature of the annealing process be within the range of 800° C. to 1100° C., and more preferably within the range of 800° C. to 1000° C.

If the duration of the annealing process is shorter than 30 seconds, the B2 phase may not be sufficiently formed, and if the duration of the secondary annealing process is longer than 60 minutes, grain coarsening may occur. Therefore, it may be preferable that the duration of the annealing process be within the range of 30 seconds to minutes, and more preferably within the range of 1 minute to 30 minutes.

Thereafter, the annealed cold-rolled steel sheet is cooled to 600° C. or lower at a cooling rate of 5° C./sec or greater, and is then coiled. If the annealed cold-rolled steel sheet is cooled at a cooling rate of less than 5° C./sec, κ-carbide ($(Fe,Mn)_3AlC$), a brittle phase, may precipitate excessively while the annealed cold-rolled steel sheet is cooled, and thus the ductility of the steel sheet may deteriorate. As the cooling rate increases, the precipitation of κ-carbide ($(Fe,Mn)_3AlC$) is more effectively prevented. Thus, according to the exemplary embodiment, the upper limit of the cooling rate may not be set.

If the cooling finish temperature of the annealed cold-rolled steel sheet is higher than 600° C. when the annealed cold-rolled steel sheet is cooled, κ-carbide ($(Fe,Mn)_3AlC$), a brittle phase, may precipitate excessively after the annealed cold-rolled steel sheet is cooled, and thus the ductility of the steel sheet may deteriorate. However, if the cooling finish temperature of the annealed cold-rolled steel sheet is lower than 600° C., problems relating to the precipitation of κ-carbide ($(Fe,Mn)_3AlC$) do not occur. Thus, according to the exemplary embodiment, the lower limit of the cooling finish temperature may not be set.

FIG. 4 is an image illustrating the microstructure of a cold-rolled steel sheet of the exemplary embodiment of the present disclosure. A B2 phase in an austenite matrix is stretched in a direction parallel to the direction of rolling and thus has a band shape having a width of about 5 μm.

FIG. 5 is an image illustrating the microstructure of the cold-rolled steel sheet of the exemplary embodiment after the cold-rolled steel sheet is annealed for about 1 minute. Since the B2 phase finely precipitates along shear bands of the austenite matrix, a deformed microstructure of austenite not shown in FIG. 4 is clearly present in FIG. 5. In addition, slip lines in B2 bands are also clearly present because austenite precipitates along the slip lines of the B2 bands.

FIG. 6 is an image illustrating the microstructure of the cold-rolled steel sheet of the exemplary embodiment after the cold-rolled steel sheet is annealed for about 15 minutes. The precipitation of the B2 phase was accelerated in the austenite matrix. In addition, the precipitation of austenite was accelerated along the slip lines of the B2 bands, and thus the B2 bands were decomposed. Referring to a lower region of FIG. 6, austenite grains having a size of about 2 μm and B2 grains having a size of about 1 μm are mixed because the B2 bands formed during a cold rolling process are decomposed in an annealing process.

FIG. 7 illustrates results of an X-ray diffraction analysis performed on a sample of the cold-rolled steel sheet of the exemplary embodiment after the cold-rolled steel sheet is annealed for about 15 minutes. Austenite and the B2 phase are only present in the microstructure of the steel sheet, and it was analyzed that the volume fraction of the B2 phase was about 33%.

MODE FOR INVENTION

Hereinafter, the present disclosure will be described more specifically according to examples. However, the following examples should be considered in a descriptive sense only and not for purposes of limitation. The scope of the present invention is defined by the appended claims, and modifications and variations may reasonably be made therefrom.

Example 1

Molten steels including alloying elements as illustrated in Table 1 were prepared using a vacuum induction melting furnace, and ingots each having a weight of about 40 kg were manufactured using the molten steels. The ingots each had a size of 300 mm (width)×250 mm (length)×80 mm (thickness). After performing a solution treatment process on the ingots, a size rolling (slab rolling) process was performed on the ingots to manufacture slabs each having a thickness of 8 mm to 25 mm.

Thereafter, reheating, hot rolling, and cold rolling processes were performed under the conditions illustrated in Table 2 so as to manufacture cold-rolled steel sheets, and the cold-rolled steel sheets were annealed under the conditions illustrated in Table 3. After that, phase fractions were measured by X-ray diffraction spectroscopy (XRD), and specific gravities were measured using a pycnometer. In addition, a tensile test was performed at an initial strain rate of $1\times10^{-3}$/sec to evaluate mechanical properties of the steel sheets. Measurement and evaluation results are illustrated in Table 3.

TABLE 1

| | Composition (wt %) | | | | | | | | | | |
|---|---|---|---|---|---|---|---|---|---|---|---|
| Steels | C | Si | Mn | P | S | Al | Ti | Nb | Cr | Ni | B |
| IS 1 | 0.01 | 4.30 | 29.5 | — | — | 4.2 | — | — | — | 4.8 | — |
| IS 2 | 0.41 | 0.02 | 15.4 | 0.013 | 0.034 | 9.7 | 0.033 | 0.003 | 0.0 | 5.0 | — |
| IS 3 | 0.63 | 0.01 | 15.2 | 0.013 | 0.028 | 9.6 | 0.036 | 0.003 | 0.0 | 5.2 | — |
| IS 4 | 0.86 | 0.02 | 16.1 | 0.014 | 0.022 | 9.6 | 0.042 | 0.004 | 0.0 | 4.9 | — |
| IS 5 | 0.99 | 0.01 | 14.4 | 0.011 | 0.007 | 9.6 | 0.027 | 0.003 | 0.0 | 4.8 | — |
| IS 6 | 1.02 | 0.01 | 14.6 | 0.011 | 0.007 | 9.7 | 0.041 | 0.004 | 0.0 | 4.8 | — |
| IS 7 | 1.25 | 0.00 | 13.8 | 0.013 | 0.024 | 9.4 | 0.020 | 0.014 | 0.0 | 4.9 | — |
| IS 8 | 1.00 | 0.07 | 20.7 | 0.019 | 0.007 | 9.5 | 0.021 | 0.011 | 0.0 | 4.7 | — |
| IS 9 | 1.04 | 0.08 | 27.2 | 0.022 | 0.009 | 8.6 | 0.030 | 0.013 | 0.1 | 4.8 | — |
| IS 10 | 1.03 | 0.05 | 32.4 | 0.024 | 0.009 | 12.2 | 0.028 | 0.014 | 0.0 | 5.1 | — |
| IS 11 | 0.86 | 0.02 | 17.4 | 0.012 | 0.007 | 10.3 | 0.036 | 0.007 | 0.0 | 1.0 | — |
| IS 12 | 0.79 | 0.02 | 17.3 | 0.013 | 0.009 | 10.3 | 0.049 | 0.007 | 0.0 | 3.0 | — |
| IS 13 | 0.82 | 0.02 | 16.9 | 0.012 | 0.007 | 9.6 | 0.047 | 0.007 | 0.0 | 4.8 | — |
| IS 14 | 0.80 | 0.01 | 17.4 | 0.012 | 0.006 | 10.3 | 0.034 | 0.007 | 0.0 | 6.9 | — |
| IS 15 | 0.68 | 0.02 | 17.4 | 0.012 | 0.008 | 10.1 | 0.041 | 0.007 | 0.0 | 8.8 | — |
| IS 16 | 1.02 | 0.09 | 26.9 | 0.022 | 0.009 | 9.8 | 0.032 | 0.012 | 0.1 | 1.0 | — |
| CS 1 | 1.03 | — | 27.4 | — | — | 11.8 | — | — | — | — | — |
| CS 2 | 1.01 | 0.08 | 26.8 | 0.024 | 0.012 | 10.0 | 0.007 | 0.012 | 0.1 | — | — |
| CS 3 | 1.04 | 0.06 | 24.6 | 0.022 | 0.023 | 10.0 | 0.020 | 0.014 | 1.3 | — | — |
| CS 4 | 0.77 | 0.00 | 14.5 | 0.011 | 0.013 | 9.2 | 0.041 | 0.012 | 0.0 | 0.1 | — |
| CS 5 | 0.09 | — | 4.9 | 0.006 | 0.002 | 8.1 | — | 0.098 | 1.4 | 0.1 | — |
| CS 6 | 0.36 | — | 3.4 | 0.009 | 0.007 | 5.8 | — | — | — | — | — |
| CS 7 | 0.59 | — | 18.1 | — | — | — | — | — | — | — | — |
| CS 8 | 0.61 | — | 17.8 | — | — | 1.5 | — | — | — | — | — |
| CS 9 | 0.61 | — | 18.0 | — | — | 1.9 | — | — | — | — | — |
| CS 10 | 0.60 | — | 18.1 | — | — | 2.3 | — | — | — | — | — |
| CS 11 | 0.62 | — | 21.9 | — | — | — | — | — | — | — | — |
| RS 1 | 0.002 | 0.006 | 0.15 | — | — | — | — | — | — | — | — |
| RS 2 | 0.09 | 0.13 | 1.8 | 0.015 | — | — | 0.001 | 0.002 | — | — | — |
| RS 3 | 0.22 | 0.24 | 1.2 | 0.009 | 0.008 | 0.0 | — | 0.030 | — | 0.2 | 0.0022 |

IS: Inventive Steel,
CS: Comparative Steel,
RS: Steel of the related art

TABLE 2

| | Reheating | | Hot rolling | | | Cooling & coiling | | Cold |
|---|---|---|---|---|---|---|---|---|
| Steels | Temp. (° C.) | Time (s) | Start temp. (° C.) | Finish temp. (° C.) | Reduction ratio (%) | Rate (° C./sec) | Coiling temp. (° C.) | Reduction ratio (%) |
| IS 1 | 1150 | 3600 | 1050 | 900 | 62.5 | 20 | 600 | 66.7 |
| IS 2 | 1150 | 7200 | 1050 | 900 | 88.0 | 20 | 600 | 66.7 |
| IS 3 | 1150 | 7200 | 1050 | 900 | 88.0 | 20 | 600 | 66.7 |
| IS 4 | 1150 | 7200 | 1050 | 900 | 88.0 | 20 | 600 | 66.7 |
| IS 5 | 1150 | 7200 | 1050 | 900 | 88.0 | 20 | 600 | 66.7 |
| IS 6 | 1150 | 7200 | 1050 | 900 | 88.0 | 20 | 600 | 66.7 |
| IS 7 | 1150 | 7200 | 1050 | 900 | 88.0 | 20 | 600 | 66.7 |

TABLE 2-continued

| Steels | Reheating Temp. (° C.) | Reheating Time (s) | Hot rolling Start temp. (° C.) | Hot rolling Finish temp. (° C.) | Hot rolling Reduction ratio (%) | Cooling & coiling Rate (° C./sec) | Cooling & coiling Coiling temp. (° C.) | Cold rolling Reduction ratio (%) |
|---|---|---|---|---|---|---|---|---|
| IS 8 | 1150 | 7200 | 1050 | 900 | 88.0 | 20 | 600 | 66.7 |
| IS 9 | 1150 | 7200 | 1050 | 900 | 88.0 | 20 | 600 | 66.7 |
| IS 10 | 1150 | 7200 | 1050 | 900 | 88.0 | 20 | 600 | 66.7 |
| IS 11 | 1150 | 7200 | 1050 | 900 | 88.0 | 20 | 600 | 66.7 |
| IS 12 | 1150 | 7200 | 1050 | 900 | 88.0 | 20 | 600 | 66.7 |
| IS 13 | 1150 | 7200 | 1050 | 900 | 88.0 | 20 | 600 | 66.7 |
| IS 14 | 1150 | 7200 | 1050 | 900 | 88.0 | 20 | 600 | 66.7 |
| IS 15 | 1150 | 7200 | 1050 | 900 | 88.0 | 20 | 600 | 66.7 |
| IS 16 | 1150 | 7200 | 1050 | 900 | 88.0 | 20 | 600 | 66.7 |
| CS 1 | 1150 | 7200 | 1050 | 900 | 88.0 | 20 | 600 | 66.7 |
| CS 2 | 1150 | 7200 | 1050 | 900 | 88.0 | 20 | 600 | 66.7 |
| CS 3 | 1150 | 7200 | 1050 | 900 | 88.0 | 20 | 600 | 66.7 |
| CS 4 | 1150 | 7200 | 1050 | 900 | 88.0 | 20 | 600 | 66.7 |
| CS 5 | 1200 | 3600 | 1050 | 900 | 95.7 | 20 | 600 | 66.7 |
| CS 6 | 1200 | 3600 | 1100 | 900 | 88.0 | 20 | 600 | 66.7 |
| CS 7 | 1150 | 7200 | 1050 | 900 | 88.0 | 20 | 600 | 53.3 |
| CS 8 | 1150 | 7200 | 1050 | 900 | 88.0 | 20 | 600 | 53.3 |
| CS 9 | 1150 | 7200 | 1050 | 900 | 88.0 | 20 | 600 | 53.3 |
| CS 10 | 1150 | 7200 | 1050 | 900 | 88.0 | 20 | 600 | 53.3 |
| CS 11 | 1150 | 7200 | 1050 | 900 | 88.0 | 20 | 600 | 53.3 |
| RS 1 | 1150 | 7200 | 1050 | 900 | 88.0 | 20 | 600 | 76.7 |
| RS 2 | 1150 | 7200 | 1100 | 900 | 88.0 | 20 | 600 | 66.7 |
| RS 3 | 1150 | 7200 | 1100 | 900 | 88.0 | 20 | 600 | 66.7 |

IS: Inventive Steel,
CS: Comparative Steel,
RS: Steel of the related art

TABLE 3

| Steels | Annealing Temp. (° C.) | Annealing Time (sec) | Cooling Rate (° C./sec) | Cooling Finish temp. (° C.) |
|---|---|---|---|---|
| IS 1 | 800 | 120 | WQ | RT |
| IS 2 | 800 | 900 | WQ | RT |
| IS 3 | 900 | 900 | WQ | RT |
| IS 4 | 900 | 900 | WQ | RT |
| IS 5 | 900 | 900 | WQ | RT |
| IS 6 | 900 | 900 | WQ | RT |
| IS 7 | 900 | 900 | WQ | RT |
| IS 8 | 900 | 900 | WQ | RT |
| IS 9 | 900 | 900 | WQ | RT |
| IS 10 | 1000 | 900 | WQ | RT |
| IS 11 | 900 | 900 | WQ | RT |
| IS 12 | 900 | 900 | WQ | RT |
| IS 13 | 900 | 900 | WQ | RT |
| IS 14 | 900 | 900 | WQ | RT |
| IS 15 | 900 | 900 | WQ | RT |
| IS 16 | 900 | 900 | WQ | RT |
| CS 1 | 1050 | 1500 | WQ | RT |
| CS 2 | 900 | 900 | WQ | RT |
| CS 3 | 900 | 900 | WQ | RT |

TABLE 3-continued

| Steels | Annealing Temp. (° C.) | Annealing Time (sec) | Cooling Rate (° C./sec) | Cooling Finish temp. (° C.) |
|---|---|---|---|---|
| CS 4 | 900 | 900 | WQ | RT |
| CS 5 | 750 | 3600 | WQ | RT |
| CS 6 | 830 | 50 | 6 | RT |
| CS 7 | 800 | 104 | 7.5 | RT |
| CS 8 | 800 | 104 | 7.5 | RT |
| CS 9 | 800 | 104 | 7.5 | RT |
| CS 10 | 800 | 104 | 7.5 | RT |
| CS 11 | 800 | 104 | 7.5 | RT |
| RS 1 | 780 | 50 | 6 | RT |
| RS 2 | 750 | 60 | 50 | RT |
| RS 3 | 930 | 600 | 35 | RT |

In table 3,
WQ: Water Quenching,
RT: Room Temperature, about 25° C.
IS: Inventive Steel,
CS: Comparative Steel,
RS: Steel of the related art

TABLE 4

| Steels | Phase fraction (volme %) γ | δ/α | B2 | DO3 | κ | α' | Mechanical properties YS (MPa) | TS (MPa) | TE (%) | UE (%) | (TS − YS)/UE (MPa/%) | Specific gravity (g/cc) |
|---|---|---|---|---|---|---|---|---|---|---|---|---|
| IS 1 | 91.8 | — | — | 8.2 | — | — | 819.7 | 1113.7 | 23.6 | 23.4 | 12.6 | 7.320 |
| IS 2 | 56.6 | — | 43.4 | — | — | — | 971.2 | 1204.2 | 11.3 | 11.3 | 20.8 | 6.846 |
| IS 3 | 60.9 | — | 39.1 | — | — | — | 981.7 | 1258.1 | 17.3 | 17.2 | 16.1 | 6.830 |
| IS 4 | 64.4 | — | 35.6 | — | — | — | 1010.7 | 1346.6 | 31.8 | 27.6 | 12.2 | 6.815 |
| IS 5 | 69.0 | — | 31.0 | — | — | — | 1107.9 | 1427.1 | 26.9 | 22.6 | 14.1 | 6.825 |
| IS 6 | — | — | — | — | — | — | 1055.1 | 1379.9 | 26.5 | 23.6 | 13.8 | 6.821 |

TABLE 4-continued

| Steels | Phase fraction (volme %) γ | δ/α | B2 | DO3 | κ | α' | Mechanical properties YS (MPa) | TS (MPa) | TE (%) | UE (%) | (TS − YS)/UE (MPa/%) | Specific gravity (g/cc) |
|---|---|---|---|---|---|---|---|---|---|---|---|---|
| IS 7 | 85.7 | — | 8.1 | — | 6.2 | — | 1174.7 | 1400.5 | 26.6 | 22.1 | 10.2 | 6.780 |
| IS 8 | 79.6 | — | 20.4 | — | — | — | 1058.1 | 1354.3 | 28.9 | 23.9 | 12.4 | 6.789 |
| IS 9 | 90.8 | — | 9.2 | — | — | — | 787.4 | 1123.6 | 34.4 | 28.1 | 12.0 | 6.855 |
| IS 10 | 82.3 | — | 17.7 | — | — | — | 1001.2 | 1358.6 | 27.6 | 27.1 | 13.2 | 6.529 |
| IS 11 | 84.7 | — | 15.3 | — | — | — | 788.2 | 1071.5 | 38.9 | 30.8 | 9.2 | 6.767 |
| IS 12 | 75.9 | — | 24.1 | — | — | — | 796.1 | 1159.4 | 34.3 | 28.7 | 12.7 | 6.769 |
| IS 13 | 66.6 | — | 33.4 | — | — | — | 945.3 | 1294.5 | 36.1 | 30.4 | 11.5 | 6.822 |
| IS 14 | 60.4 | — | 39.6 | — | — | — | 1024.7 | 1377.0 | 36.2 | 31.1 | 11.3 | 6.810 |
| IS 15 | 54.7 | — | 45.3 | — | — | — | 1018.2 | 1340.0 | 27.8 | 27.5 | 11.7 | 6.840 |
| IS 16 | 97.1 | 1.4 | 1.5 | — | — | — | 637.1 | 1009.3 | 42.1 | 37.4 | 10.0 | 6.718 |
| CS 1 | 83.2 | 9.7 | — | — | 7.1 | — | 741.1 | 1014.6 | 53.9 | 45.3 | 6.0 | 6.512 |
| CS 2 | 100 | 0 | — | — | — | — | 576.8 | 956.3 | 56.7 | 49.1 | 7.7 | 6.703 |
| CS 3 | 93.3 | 6.7 | — | — | — | — | 757.4 | 1077.4 | 49.4 | 40.7 | 7.9 | 6.700 |
| CS 4 | 77.9 | 22.1 | — | — | — | — | 797.3 | 1022.4 | 41.2 | 32.8 | 6.9 | 6.801 |
| CS 5 | 0 | 100 | — | — | — | — | 590.2 | 690.8 | 32.4 | 15.4 | 6.5 | 7.060 |
| CS 6 | 30.3 | 69.7 | — | — | — | — | 614.0 | 810.0 | 44.1 | 37.6 | 5.2 | 7.224 |
| CS 7 | 100 | — | — | — | — | — | 449.2 | 1089.4 | 60.1 | 57.4 | 11.2 | 7.913 |
| CS 8 | 100 | — | — | — | — | — | 432.8 | 943.2 | 64.2 | 57.6 | 8.9 | 7.724 |
| CS 9 | 100 | — | — | — | — | — | 447.3 | 890.7 | 59.9 | 52.3 | 8.5 | 7.644 |
| CS 10 | 100 | — | — | — | — | — | 449.8 | 865.5 | 55.3 | 50.6 | 8.2 | 7.588 |
| CS 11 | 100 | — | — | — | — | — | 404.5 | 1049.1 | 63.6 | 62.3 | 10.3 | 7.891 |
| RS 1 | — | 100 | — | — | — | — | 154.1 | 287.9 | 50.6 | 28.6 | 4.7 | 7.830 |
| RS 2 | — | 87.3 | — | — | — | 12.7 | 329.0 | 589.0 | 25.5 | 17.4 | 14.9 | 7.791 |
| RS 3 | — | — | — | — | — | 100 | 1133.1 | 1531.3 | 8.0 | 4.8 | 83.0 | 7.804 |

IS: Inventive Steel,
CS: Comparative Steel,
RS: Steel of the related art

As illustrated in Table 4, Inventive Steels 1 to 16 each have a dual phase structure formed by an austenite matrix and a B2-structure or DO3-structure intermetallic compound, and some of Inventive Steels 1 to 16 include κ-carbide in an amount of 15% or less. In addition, Inventive Steels 1 to 16 each have a specific gravity of 7.47 g/cc or less, a yield strength of 600 MPa or greater, a product of ultimate tensile strength (TS) and total elongation (TE) within the range of 12,500 MPa·% or greater, and an average strain hardening rate calculated by (TS−YS)/UE (where UE refers to uniform elongation in percentage (%)) within the range of 8 MPa/% or greater.

Although Comparative Steels 1 to 4 are lightweight steels having an austenite matrix like the inventive steels, Comparative Steels 1 to 4 do not include a B2-structure or DO3-structure intermetallic compound as a secondary phase. Although comparative Steels 1 to 4 have high ductility, the average strain hardening rate ((TS−YS)/UE) of each of Comparative Steel 1 to 4 is much lower than the inventive steels.

In addition, although Comparative Steels 5 and 6 are lightweight steels having a ferrite matrix (A2 structure: disordered BBC), the ultimate tensile strength and average strain hardening rate ((TS-YS)/UE) are much lower than the inventive steels.

In addition, Comparative Steels 7 to 11 are twinning-induced plasticity (TWIP) steels having a single FCC phase. Although some of the TWIP steels have an average strain hardening rate ((TS−YS)/UE) similar to that of the inventive steels, the TWIP steels are not considered as being lightweight because the specific gravities thereof are not reduced or slightly reduced, and the yield strength of the TWIP steels is much lower than the inventive steels.

In addition, Steels 1 to 3 of the related art are interstitial free (IF) steel, dual phase (DP) steel, and hot press forming (HPF) steel, respectively. When compared to Comparative Steels 1 to 11 and Steels 1 to 3 of the related art, Inventive Steels 1 to 16 having a new microstructure have a high degree of strength, a high degree of elongation, a high strain hardening rate, and a lightweight.

Example 2

In order to evaluate the effect of annealing conditions on mechanical properties of steel sheets, reheating, hot rolling, cooling, coiling, and cold rolling processes were sequentially performed on Inventive Steel 4 under the conditions described in Example 1, and then an annealing process was performed under the conditions illustrated in Table 5. Thereafter, a tensile test was performed in the same manner as in Example 1, and results thereof are illustrated in Table 5.

TABLE 5

| No. | Annealing conditions Temp. (° C.) | Time (sec) | Cooling rate (° C./sec) | Mechanical properties YS (MPa) | TS (MPa) | TE (%) | UE (%) | (TS − YS)/UE (MPa/%) | Specific gravity (g/cc) |
|---|---|---|---|---|---|---|---|---|---|
| 1 | 870 | 900 | WQ | 1182.4 | 1470.6 | 25.9 | 22.7 | 12.7 | 6.815 |
| 2 | 870 | 900 | 30 | 1245.3 | 1484.5 | 22.5 | 20.4 | 11.7 | 6.815 |

TABLE 5-continued

| | Annealing conditions | | | Mechanical properties | | | | | |
|---|---|---|---|---|---|---|---|---|---|
| No. | Temp. (° C.) | Time (sec) | Cooling rate (° C./sec) | YS (MPa) | TS (MPa) | TE (%) | UE (%) | (TS − YS)/UE (MPa/%) | Specific gravity (g/cc) |
| 3 | 870 | 900 | 10 | 1280.3 | 1504.9 | 16.9 | 16.7 | 13.4 | 6.815 |
| 4 | 870 | 120 | WQ | 1288.8 | 1512.8 | 24.6 | 19.4 | 11.5 | 6.815 |
| 5 | 920 | 120 | 30 | 1355.4 | 1547.9 | 20.3 | 18.0 | 10.7 | 6.815 |

Referring to Table 5, even steel sheets of the same type have different mechanical properties according to annealing conditions. Particularly, Inventive Steel 4 has superior mechanical properties after annealed at a temperature of 870° C. to 920° C. for 2 minutes to 15 minutes and then cooled at a rate of 10° C./sec or greater.

Example 3

Unlike in Examples 1 and 2, a hot-rolled steel sheet was manufactured by the manufacturing method (1) described above. In detail, a steel slab having a composition illustrated in Table 6 was reheated to 1150° C. for 7200 seconds, and a hot rolling process was performed on the reheated steel slab to manufacture a hot-rolled steel sheet. At that time, the start temperature, finish temperature, and reduction ratio of the hot rolling process were 1050° C., 900° C., and 84.4%, respectively. Thereafter, the hot-rolled steel sheet was water quenched to 600° C. and then coiled. After that, a tensile test was performed in the same manner as in Example 1, and results thereof are illustrated in Table 7.

TABLE 6

| | Composition (wt %) | | | | | | | | | | |
|---|---|---|---|---|---|---|---|---|---|---|---|
| Steels | C | Si | Mn | P | S | Al | Ti | Nb | Cr | Ni | B |
| IS 17 | 0.76 | 0.00 | 14.3 | 0.010 | 0.009 | 9.6 | 0.033 | 0.012 | 0.0 | 5.0 | — |

IS: Inventive Steel

TABLE 7

| | Phase fraction (volume %) | | | | | | Mechanical properties | | | | |
|---|---|---|---|---|---|---|---|---|---|---|---|
| | | | | | | | YS | TS | TE | UE | (TS − YS)/UE |
| Steels | γ | δ/α | B2 | DO3 | κ | α' | (MPa) | (MPa) | (%) | (%) | (MPa/%) |
| IS 17 | 74.1 | — | 25.9 | — | — | — | 886.1 | 1094.2 | 17.3 | 16.9 | 12.3 |

IS: Inventive Steel

As illustrated in Table 7, the hot-rolled steel sheet manufactured by the manufacturing method (1) has a dual phase structure formed by an austenite matrix and a B2-structure or DO3-structure intermetallic compound and has a yield strength of 600 MPa or greater, a product of ultimate tensile strength (TS) and total elongation (TE) within the range of 12,500 MPa·% or greater, and an average strain hardening rate calculated by (TS−YS)/UE (where UE refers to uniform elongation in percentage (%)) within the range of 8 MPa/% or greater.

Example 4

Unlike in Examples 1 to 3, hot-rolled steel sheets were manufactured by the manufacturing method (2) described above. In detail, steel slabs having the same composition as that of Inventive Steel 5 were reheated to 1150° C. for 7200 seconds, and a hot rolling process was performed on the reheated steel slabs to manufacture hot-rolled steel sheets. At that time, the start temperature, finish temperature, and reduction ratio of the hot rolling process were 1050° C., 900° C., and 88.0%, respectively. Thereafter, the hot-rolled steel sheets were cooled to 600° C. at a rate of 20° C./sec, and then coiled. After that, the coiled hot-rolled steel sheets were annealed and cooled under the conditions illustrated in Table 8 below. In the same manner as in Example 2, the phase fractions and specific gravity of the steel sheets were measured, and a tensile test was performed on the steel sheet. Results thereof are illustrated in Table 8.

TABLE 8

| | Annealing conditions | | | Phase fraction (volume %) | | Mechanical properties | | | | | |
|---|---|---|---|---|---|---|---|---|---|---|---|
| No. | Temp. (° C.) | Time (sec) | Cooling rate (° C./sec) | γ | B2 | YS (MPa) | TS (MPa) | TE (%) | UE (%) | (TS − YS)/UE (MPa/%) | Specific gravity (g/cc) |
| 1 | 1100 | 3600 | 20 | 92.7 | 7.3 | 738.1 | 930.7 | 14.7 | 12.6 | 17.7 | 6.825 |
| 2 | 1100 | 900 | WQ | 82.9 | 17.3 | 964.5 | 1219.8 | 19.5 | 18.8 | 13.6 | 6.825 |

As illustrated in Table 8, the hot-rolled steel sheets manufactured by the manufacturing method (2) have a dual phase structure formed by an austenite matrix and a B2-structure or DO3-structure intermetallic compound, and have a yield strength of 600 MPa or greater, a product of ultimate tensile strength (TS) and total elongation (TE) within the range of 12,500 MPa·% or greater, and an average strain hardening rate calculated by (TS−YS)/UE (where UE refers to uniform elongation in percentage (%)) within the range of 8 MPa/% or greater.

Example 5

Unlike in Examples 1 to 4, a hot-rolled steel sheet was manufactured by the manufacturing method (3) described above. In detail, a steel slab having the same composition as that of Inventive Steel 5 was reheated to 1150° C. for 7200 seconds, and a hot rolling process was performed on the reheated steel slab to manufacture a hot-rolled steel sheet. At that time, the start temperature, finish temperature, and reduction ratio of the hot rolling process were 1050° C., 900° C., and 88.0%, respectively. Thereafter, the hot-rolled steel sheet was cooled to 600° C. at a rate of 20° C./sec, and then coiled. Next, a primary annealing process was performed on the coiled hot-rolled steel sheet at 1000° C. for 3600 seconds, and then the annealed hot-rolled steel sheet was cooled at a rate of 20° C./sec. Next, a secondary annealing process was performed on the cooled hot-rolled steel sheet at 800° C. for 900 seconds, and then the annealed hot-rolled steel sheet was water quenched. After that, in the same manner as in Example 1, the phase fractions and specific gravity of the steel sheet were measured, and a tensile test was performed on the steel sheet. Results thereof are illustrated in Table 9.

As illustrated in Table 9, the hot-rolled steel sheet manufactured by the manufacturing method (3) has a dual phase structure formed by an austenite matrix and a B2-structure or DO3-structure intermetallic compound, and has a yield strength of 600 MPa or greater, a product of ultimate tensile strength (TS) and total elongation (TE) within the range of 12,500 MPa·% or greater, and an average strain hardening rate calculated by (TS−YS)/UE (where UE refers to uniform elongation in percentage (%)) within the range of 8 MPa/% or greater.

Example 6

Unlike in Examples 1 to 5, a cold-rolled steel sheet was manufactured by the manufacturing method (5) described above. In detail, a steel slab having the same composition as that of Inventive Steel 12 was reheated to 1150° C. for 7200 seconds, and a hot rolling process was performed on the reheated steel slab to manufacture a hot-rolled steel sheet. At that time, the start temperature, finish temperature, and reduction ratio of the hot rolling process were 1050° C., 900° C., and 88.0%, respectively. Thereafter, the hot-rolled steel sheet was cooled to 600° C. at a rate of 20° C./sec, and then coiled. Next, the coiled hot-rolled steel sheet was annealed at 1100° C. for 900 seconds and was then cold rolled at a reduction ratio of 66.7% to manufacture a cold-rolled steel sheet. Next, the cold-rolled steel sheet was annealed at 900° C. for 900 seconds and was water quenched. After that, in the same manner as in Example 1, the phase fractions, specific gravity of the steel sheet were measured, and a tensile test was performed on the steel sheet. Results thereof are illustrated in Table 10.

TABLE 9

| | Phase fraction (volme %) | | | | | | Mechanical properties | | | | | |
|---|---|---|---|---|---|---|---|---|---|---|---|---|
| Steels | γ | δ/α | B2 | DO3 | κ | α' | YS (MPa) | TS (MPa) | TE (%) | UE (%) | (TS − YS)/UE (MPa/%) | Specific gravity (g/cc) |
| IS 5 | 74.6 | — | 15.1 | — | 10.3 | — | 771.8 | 1056.1 | 15.8 | 15.8 | 18.0 | 6.825 |

IS: Inventive Steel

TABLE 10

| | Phase fraction (volume %) | | | | | | Mechanical properties | | | | | |
|---|---|---|---|---|---|---|---|---|---|---|---|---|
| | | | | | | | YS | TS | TE | UE | (TS − YS)/UE | Specific gravity |
| Steels | γ | δ/α | B2 | DO3 | κ | α' | (MPa) | (MPa) | (%) | (%) | (MPa/%) | (g/cc) |
| IS 12 | 76.2 | — | 23.8 | — | — | — | 783.2 | 1160.3 | 36.2 | 29.2 | 12.9 | 6.769 |

IS: Inventive Steel

As illustrated in Table 10, the cold-rolled steel sheet manufactured by the manufacturing method (5) has a dual phase structure formed by an austenite matrix and a B2-structure or DO3-structure intermetallic compound, and has a yield strength of 600 MPa or greater, a product of ultimate tensile strength (TS) and total elongation (TE) within the range of 12,500 MPa·% or greater, and an average strain hardening rate calculated by (TS−YS)/UE (where UE refers to uniform elongation in percentage (%)) within the range of 8 MPa/% or greater.

The invention claimed is:

1. A high specific strength steel sheet comprising: an Fe—Al-based intermetallic compound in an austenite matrix in a volume fraction of 1% to 50%; and κ-carbide ($(Fe,Mn)_3AlC$), a perovskite carbide having an L12 structure in the austenite matrix, in a volume fraction of 15% or less, wherein the high specific strength steel sheet comprises, by wt %, C: 0.01% to 2.0%, Si: 9.0% or less, Mn: 5.0% to 40.0%, P: 0.04% or less, S: 0.04% or less, Al: 4.0% to 20.0%, Ni: 0.3% to 20.0%, N: 0.001% to 0.05%, and a balance of iron (Fe) and inevitable impurities, wherein if manganese (Mn) is included in an amount of 5.0% to less than 14.0%, carbon (C) is included in an amount of 0.6% or greater, and if manganese (Mn) is included in an amount of 14.0% to less than 20.0%, carbon (C) is included in an amount of 0.3% or greater, wherein the high specific strength steel sheet has a specific gravity of 7.47 Wee or less, a yield strength (YS) of 600 MPa or greater, a product (TS×TE) of ultimate tensile strength (TS) and total elongation (TE) within a range of 12,500 MPa % a or greater, and an average strain hardening rate calculated by (TS−YS)/UE (where UE refers to uniform elongation in percentage (%)) within a range of 8 MPa/% or greater, and wherein the high specific strength steel sheet comprises ferrite in a volume fraction of 5% or less.

2. The high specific strength steel sheet of claim 1, wherein the Fe—Al-based intermetallic compound is included in a volume fraction of 5% to 45%.

3. The high specific strength steel sheet of claim 1, wherein the κ-carbide ($(Fe,Mn)_3AlC$), a perovskite carbide having an L12 structure, is included in a volume fraction of 7% or less.

4. The high specific strength steel sheet of claim 1, wherein the Fe—Al-based intermetallic compound has granular form and an average grain diameter of 20 μm or less.

5. The high specific strength steel sheet of claim 1, wherein the Fe—Al-based intermetallic compound has granular form and has an average grain diameter of 2 μm or less.

6. The high specific strength steel sheet of claim 1, wherein the Fe—Al-based intermetallic compound has granular form and has an average grain diameter of 20 μm or less, or the Fe—Al-based intermetallic compound has a band shape parallel to a rolling direction of the high specific strength steel sheet.

7. The high specific strength steel sheet of claim 6, wherein the Fe—Al-based intermetallic compound having a band shape parallel to the rolling direction of the high specific strength steel sheet is included in a volume fraction of 40% or less.

8. The high specific strength steel sheet of claim 6, wherein the Fe—Al-based intermetallic compound having a band shape parallel to the rolling direction of the high specific strength steel sheet has an average thickness of 40 μm or less, an average length of 500 μm or less, and an average width of 200 μm or less.

9. The high specific strength steel sheet of claim 1, wherein the Fe—Al-based intermetallic compound has a B2 structure or a DO3 structure.

10. The high specific strength steel sheet of claim 1, further comprising, by wt %, at least one selected from the group consisting of Cr: 0.01% to 7.0%, Co: 0.01% to 15.0%, Cu: 0.01% to 15.0%, Ru: 0.01% to 15.0%, Rh: 0.01% to 15.0%, Pd: 0.01% to 15.0%, Ir: 0.01% to 15.0%, Pt: 0.01% to 15.0%, Au: 0.01% to 15.0%, Li: 0.001% to 3.0%, Sc: 0.005% to 3.0%, Ti: 0.005% to 3.0%, Sr: 0.005% to 3.0%, Y: 0.005% to 3.0%, Zr: 0.005% to 3.0%, Mo: 0.005% to 3.0%, Lu: 0.005% to 3.0%, Ta: 0.005% to 3.0%, a lanthanoid rare earth metal (REM): 0.005% to 3.0%, V: 0.005% to 1.0%, Nb: 0.005% to 1.0%, W: 0.01% to 5.0%, Ca: 0.001% to 0.02%, Mg: 0.0002% to 0.4%, and B: 0.0001% to 0.1%.

* * * * *